United States Patent [19]

Mullay et al.

[11] Patent Number: 4,830,687

[45] Date of Patent: May 16, 1989

[54] STABLE FLUID SYSTEMS FOR PREPARING HIGH DENSITY EXPLOSIVE COMPOSITIONS

[75] Inventors: John J. Mullay, Hazeltown; Joseph A. Sohara, Whitehall, both of Pa.

[73] Assignee: Atlas Powder Company, Dallas, Tex.

[21] Appl. No.: 123,865

[22] Filed: Nov. 23, 1987

[51] Int. Cl.[4] ..... C06B 45/00

[52] U.S. Cl. ..... 149/2; 149/46; 149/61; 149/109.6

[58] Field of Search ..... 149/2, 109.6, 46, 61

[56] References Cited

U.S. PATENT DOCUMENTS

| | | | |
|---|---|---|---|
| 3,004,842 | 10/1961 | Rowlinson | 52/14 |
| 3,052,578 | 9/1962 | Davis et al. | 149/60 |
| 3,111,437 | 11/1963 | Hino et al. | 149/21 |
| 3,124,495 | 3/1964 | Hradel | 149/43 |
| 3,139,029 | 6/1964 | Bjork | 102/23 |
| 3,161,551 | 12/1964 | Egly et al. | 149/46 |
| 3,164,503 | 1/1965 | Gehrig | 149/18 |
| 3,231,437 | 1/1966 | Berthmann et al. | 149/101 |
| 3,242,019 | 3/1966 | Gehrig | 149/18 |
| 3,249,477 | 5/1966 | Clay et al. | 149/41 |
| 3,264,151 | 8/1966 | Schrieber et al. | 149/41 |
| 3,275,485 | 9/1966 | Egly | 149/47 |
| 3,282,753 | 1/1966 | Cook et al. | 149/46 |
| 3,288,661 | 11/1966 | Swisstack | 149/60 |
| 3,307,986 | 3/1967 | Grant | 149/21 |
| 3,326,734 | 6/1967 | Slykhouse | 149/41 |
| 3,347,722 | 10/1967 | Gordon | 149/41 |
| 3,356,547 | 12/1967 | Berthmann | 149/51 |
| 3,379,587 | 4/1968 | Cook | 149/39 |
| 3,447,978 | 6/1969 | Bluhm | 149/2 |
| 3,715,247 | 2/1973 | Wade | 149/21 |
| 3,764,421 | 10/1973 | Clark | 149/46 |
| 3,765,964 | 10/1973 | Wade | 149/2 |
| 3,787,254 | 1/1974 | Cook et al. | 149/60 |
| 3,943,820 | 3/1976 | Persson | 86/20 |
| 3,956,040 | 5/1976 | Tezuka | 149/41 |
| 4,111,727 | 5/1978 | Clay | 149/2 |
| 4,141,767 | 2/1979 | Sudweeks et al. | 149/2 |
| 4,181,546 | 1/1980 | Clay | 149/21 |
| 4,294,633 | 10/1981 | Clay | 149/2 |
| 4,310,364 | 1/1982 | Ekman et al. | 149/2 |
| 4,357,184 | 11/1982 | Binet et al. | 149/2 |
| 4,409,044 | 10/1983 | Bhattacharyya et al. | 149/2 |
| 4,426,238 | 1/1984 | Wasson | 149/60 |
| 4,490,195 | 12/1984 | Cooper et al. | 149/2 |
| 4,500,369 | 2/1985 | Tag et al. | 149/2 |
| 4,509,998 | 4/1985 | Hajto | 149/2 |
| 4,523,967 | 6/1985 | Cartwright | 149/2 |
| 4,555,278 | 11/1985 | Cescon et al. | 149/21 |
| 4,585,495 | 4/1986 | Honeyman et al. | 149/2 |
| 4,615,751 | 10/1986 | Smith et al. | 149/2 |
| 4,664,729 | 5/1987 | Rehman | 149/2 |
| 4,737,207 | 4/1988 | Ehrnstromm et al. | 149/2 |

FOREIGN PATENT DOCUMENTS

| | | |
|---|---|---|
| 281537 | 3/1967 | United Kingdom . |
| 1306546 | 2/1973 | United Kingdom . |

OTHER PUBLICATIONS

"Ammonium Nitrate Explosives Some Experimental Mixes", by R. V. Coxon, Paper No. 9 from the Australasian Institute of Mining and Metallurgy.

"The Use of Surface Active Agents to Sensitize AN/FO Mixtures", by R. W. Coxon, Paper No. 3 from the Australasian Institute of Mining and Metallurgy.

*Primary Examiner*—Stephen J. Lechert, Jr.

*Attorney, Agent, or Firm*—Richards, Harris, Medlock & Andrews

[57] ABSTRACT

The invention provides a thermodynamically stable fluid system for use in combination with a solid oxidizer to provide an explosive composition. The fluid system comprises 1–70% by weight of water, 5–20% by weight of a surfactant, 0–35% by weight of a cosurfactant, and 5–85% by weight of an organic oil. Any droplet formation within the system has diameter or a thickness of less than or equal to about 0.1 microns. In a preferred embodiment, the fluid system is a microemulsion. When the fluid system is combined with a solid oxidizer, an explosive composition is formed, and the resulting explosive composition has a density greater than ANFO under similar conditions. The fluid system acts to increase the density of the oxidizer.

62 Claims, No Drawings

STABLE FLUID SYSTEMS FOR PREPARING HIGH DENSITY EXPLOSIVE COMPOSITIONS

TECHNICAL FIELD

The invention relates to thermodynamically stable fluid systems comprising water, surfactant species, including a cosurfactant, and an organic oil that forms an explosive composition when combined with a solid oxidizer. The fluid systems may be further defined by the diameter of any droplet formation in the fluid system being less than or equal to 0.1 microns. When mixed with a solid oxidizer such as ammonium nitrate prlls, the effect of the fluid systems is to increase the density of the mixture. The invention also includes a method for increasing the density of explosive compositions containing solid oxidizers that includes mixing the solids with a fluid system as described.

BACKGROUND

The invention relates to stable fluid systems to be used in combination with a solid oxidizer in preparing an explosive composition. More particularly, the invention relates to a microemulsion that may be used to provide an explosive composition with a greater density than a typical nitrate/fuel oil explosive.

Mixtures of ammonium nitrate (AN) and diesel fuel oil (FO) have been used for many years in the explosives industry. Typically, ammonium nitrate in prill form is mixed with diesel fuel oil in the ratio of about 94to 6, and the mixture has come to be known as ANFO. ANFO is inexpensive and is widely used in various kinds of blasting, but its relatively low bulk density (about 0.8 g/cc) limits the amount of useful energy that can be obtained per borehole. ANFO also becomes desensitized by water which precludes its sse in water-filled boreholes.

Various attempts have been made to increase the density or bulk strength of ANFO, and thereby provide more energy per volume. Some examples of these attempts include the use of high density additive fuels (e.g. ferrophosphorous), crushing the ammonium nitrate, and the use of thickened water-based AN slurries. The use of high density fuels requires special equipment for addition of the fuels to the prills which increases the cost of the explosive. Similarly, special equipment and personnel are required for partially crushing the prills which also results in increased costs. Slurries have the problem of lacking sensitivity and require the addition of sensitizing agents as well as additional equipment.

U.S. Pat. No. 3,764,421 describes another attempt to solve the density problem of ANFO that includes adding water in controlled amounts to a prilled ANFO, aging the resulting mixture for a period of time (typically 10–14 days), and ther mixing the prilled ANFO such that it breaks down into finely-divided solids. This approach essentially achieves the same result as partially crushing the prills but uses aging instead of special equipment. A need still exists for a method and formulation for increasing the density of a solid oxidizer based system over that obtainable with ANFO without the use of special equipment or aging.

The explosives art has also sought to improve the sensitivity of ANFO in various ways. Australian Pat. No. 281537 to Coxon describes an explosive using ammonium nitrate prills with an emulsion of fuel oil, water and an anionic surface agent or emulsifier. Coxon attempted to improve the sensitivity of ANFO by adding a small amount of water and distributing it with oil in the form of an emulsion over the ammonium nitrate In this manner, Coxon achieved greater intimacy between the oil and the AN thereby achieving greater sensitivity. Coxon describes oil-in-water emulsions in which water is the continuous phase as being generally more stable, and therefore, preferred over water-in-oil emulsions. For Coxon's intended use, the emulsion need only be stable for a few minutes after mixing.

The explosives industry addressed the problem of making a waterproof explosive using ammonium nitrate and fuel oil by forming the components into a water gel or a water-in-oil emulsion. U.S. Pat. No. 3,447,978 to Bluhm discloses a water-in-oil emulsion explosive in which an aqueous solution of oxidizing salts form the discontinuous aqueous phase, and the continuous phase is formed with a fuel. The emulsion also has an occluded gas component and an emulsifier. The occluded gas was included to lower the density of the emulsion thereby increasing the sensitivity. Without the occluded gas, the emulsion is not detonable. Later patents, such as U.S. Pat. No. 3,765,964 included sensitizers such as strontimm in addition to occluded gas to increase the sensitivity of the emulsion.

Numerous other patents also describe explosive compositions that incorporate oxidizing agents as part of the aqueous phase of an emulsion. Examples include U.S. Pat. No. 3,161,551 to Egly et al. which discloses a water-in-oil emulsion containing 50–70% by weight of ammonium nitrate, 15–35% water, 5–20% of an organic sensitizer and a small amount of emulsifiers that may be combined with particulate ammonium nitrate. Egly teaches to combine the emulsion with particulate ammonium nitrate so as to fill all the spaces between the particles. U.S. Pat. No. 3,356,547 to Berthmann et al. describes an emulsion containing nitroglycerin that is used with solid AN particles.

Clay in U.S. Pat. No. 4,111,727 discloses an explosive composition formed by mixing 10 to 40% of a water-in-oil emulsion containing an oxidizer salt dissolved in the water phase with 60 to 90% of solid oxidizer such as ammonium nitrate. The two components are mixed such that sufficient air is left in the interstitial spaces of the solid oxidizer to render the mixture detonable. The emulsion does not need to contain occluded gas.

Clay in U.S. Pat. No. 4,181,546 discloses a waterproof explosive comprising 40 to 60% by weight of a solid, particulate oxidizer salt and 60 to 40% of a water-in-oil emulsion containing an oxidizer salt dissolved in the water and combined with an oil component held in a stable emulsion condition by a small quantity of emulsifier. The emulsion also contains a density controlled sensitizer such as hollow glass beads, polystyrene beads, microballoons or the equivalent. The components are thoroughly mixed together to substantially eliminate voids between the solid granules.

In a later patent, U.S. Pat. No. 4,294,633, Clay disclosed a blasting composition of 60 to 90% by weight of solid particulate oxidizer salt and 10 to 40% of a liquid slurry partially filling the interstices and voids between the solid particles. The slurry is a substantially saturated and thickened solution of strong oxiiizer salt so as not to appreciably dissolve or soften the granules.

A disadvantage of water-in-oil emulsions in which the aqueous phase contains dissolved oxidizer salts is that the emulsions are highly viscous compared to diesel fuel oil and require special handling and equipment.

Also, such emulsions are relatively unstable and will separate or "break" into different phases on temperature cycling. When such emulsions are used in mixtures as described in the Clay U.S. Pat. Nos. 4,181,546 and 4,111,727 patents, they are generally stored separately until mixed with the solid oxidizer particles. In order to prevent phase separation in cold climates, it is usually necessary to heat the emulsion continuously from production until use. These same disadvantages are characteristic of almost all of the emulsions presently used in the explosives industry. They all exhibit limited stability over time and sensitivity to temperature cycling.

U.S. Pat. No. 4,555,278, to Cescon, et al. describes a stable blend of nitrate particles and a water-in-oil emulsion formed with an anionic emulsifying agent comprising a fatty acid salt. The stability of the blend is achieved by controlling the cell size of the dispersed aqueous phase in the emulsion so as to decrease the chemical driving force between the water and the solid oxidizer. Cescon states that "the optimum cell size of the internal phase of an emulsion in a blend is the largest that will not crystallize on losing water over the goal shelf life of the product." (Col. 7 lines 46–48). Cescon further recites that the optimum cell size is within the range 1–4 microns, "decreasing as the aqueous phase water content decreases." (Col. 7 lines 52–53).

Another example of an explosive emulsifier system is disclosed in U.S. Pat. No. 4,357,184 to Binet. Binet discloses explosive systems consisting of synthetic polymeric emulsifiers that produce a relatively stable water-in-oil emulsion. The emulsions comprise an aqueous solution of at least one oxygen-supplying salt as a discontinuous phase, an insoluble liquid or liquefiable carbonaceous fuel as a continuous phase, a sensitizing component and a blend of emulsifying agents. Binet describes the emulsions as "ultra-stable colloidal dispersions" and uses the term microemulsion. As used by Binet, the term microemulsion describes a liquid-liquid foam of very small cell size ranging from about 1 micron to about 15 microns. In the emulsion art, however, the term microemulsion means something different than that described by Binet. What Binet termed a microemulsion is more properly termed a small cell macroemulsion.

Contrary to the use in Binet, the term "microemulsion" as used in the emulsion art, and as used in describing the present invention, is a system of water, oil and amphiphile(s) which spontaneously form a liquid solution with droplets or cells of less than 0.1 microns in diameter. Macroemulsions are generally recognized as having a cell size greater than 1 micron as disclosed in Binet and Cescon. "Amphiphile(s)" are surfactant and cosurfactant species. Microemulsions are generally recognized as being thermodynamically stable, i.e., infinitely stable over a fixed range of temperatures and pressures. Thermodynamic stability also implies that the emulsions form spontaneously without the input of additional energy. Macroemulsions, on the other hand, are inherently unstable and are useful for only a limited time. Extreme conditions in transport, storage and handling may significantly reduce the useful life of a macroemulsion. Another characteristic of macroemulsions is that they require energy to form, e.g. usually vigorous mixing. Special equipment is necessary to accomplish this mixing. In its lowest energy state, the microemulsion will form essentially a single, homogeneous phase with small microdroplets. By contrast, a macroemulsion is a two-phase system. Generally, microemulsions are optically isotropic which implies that a beam of polarized light will be refracted through the solution in the same way regardless of the angle of the beam, although anisotropy is recognized in some microemulsions. Macroemulsions are usually opaque and sometimes translucent.

The fluid systems of th present invention exhibit the characteristics of a true microemulsion. In particular, the fluid systems exhibit remarkable stability that allows for extended storage and use under varying conditions. In addition, when the fluid systems are added to a solid oxidizer they act to increase the density of the solid and of the resulting explosive system. These features result in a very desirable explosive composition. Indeed, the explosive compositions of the present invention can be used as a replacement for ANFO while using the same equipment as is presently used for ANFO and providing a product with a greater density and bulk strength.

SUMMARY OF THE INVENTION

The present invention provides thermodynamically stable fluid systems for use in combination with a solid oxidizer to form explosive compositions. The fluid systems may comprise the combination of water, a surfactant, a cosurfactant and an organic oil. The fluid systems may comprise a microemulsion, a micellar solution, a cosolubilized solution or any other system that is thermodynamically stable at about 25° C. and atmospheric pressure, that forms an explosive composition when added to a solid oxidizer such as ammonium nitrate, and any droplets contained in the fluid system have a diameter of less than or equal to about 0.1 microns. The preferred fluid system is a microemulsion that is clear and isotropic.

In one embodiment of the invention, the fluid system contains water in the amount of 1–70 percent by weight of the system, a surfactant in the amount of 5–20 percent by weight, a cosurfactant in the amount of 0–35 percent by weight, and 5–85 percent by weight of an organic oil. The surfactants may be any anionic, cationic or nonionic material that is partially soluble in both the water and oil phases. The cosurfactants are generally low-molecular weight, polar species such as lower alcohols, amines, ketones, sulfones and amides. The preferred organic oils are selected from petroleum distillates, such as diesel fuel oil, and other vegetable or mineral oils. Additionally, other components such as oxidizers or fuels may be added to the system. The fuels may be water-soluble or soluble in the oil component The preferred ranges on the components of the fluid systems are 25–50% water, 10–40% oil, 5–20% surfactant and 10–35% cosurfactant.

The present invention also provides an explosive composition comprising the mixture of a solid oxidizer with a fluid system as described above. In a preferred embodiment, the oxidizer is selected from ammonium nitrate, sodium nitrate, potassium nitrate, calcium nitrate or mixtures thereof. Most preferably, the oxidizer is principally or solely ammonium nitrate in prill form. The explosive composition may comprise 85–98% by weight of the oxidizer and 2–15% by weight of the fluid system. Furthermore, the oxidizer and fluid system may be proportioned so as to provide an oxygen balanced system relative to carbon dioxide. In use, the fluid systems act to increase the density of the solid oxidizer as the water is absorbed within the oxidizer.

The invention further provides a method of increasing the density of an explosive composition containing a solid oxidizer such as ANFO or AN prills. The method comprises forming a fluid system as described and mixing the system with the solids to adequately coat the solids and allow the water in the system to come in contact with the solids.

DETAILED DESCRIPTION

The present invention includes a formulation and a method for providing an explosive composition that can utilize nitrate prills but achieves a higher density than ANFO. The discovery involves the use of a water and oil fluid system which can be mixed with a solid oxidizer on the blast site and delivered to the borehole using current equipment available to users of ANFO.

The fluid systems included in the present invention are thermodynamically stable at about 25° C. and form an explosive composition when combined with an oxidizer. Also, any droplet formation within the system has a diameter of less than or equal to about 0.1 microns. Included in these fluid systems are systems known in the art as microemulsions, micellar solutions and cosolubilized systems. In a preferred embodiment, the fluid system is a microemulsion that is relatively clear and optically isotropic. Additionally, the microemulsion may be prepared to look, feel and handle in a manner that is nearly identical to diesel fuel oil thereby allowing use of equipment previously used for ANFO. While a microemulsion is preferred, the invention encompasses any fluid system formed from the components given below and that exhibits the same essentially infinite stability and external appearance as a microemulsion although it may not rigorously assume the physical structure of a true microemulsion, i.e., dispersed microdroplets in a continuous liquid medium.

In describing and claiming the preeent invention, the term "thermodynamically stable" means that the system forms spontaneously at about a temperature of 25° C. and near atmospheric pressure without any work being input, and the system remains in that state indefinitely without any propensity to separate into two phases. In essence, over a given range of temperatures and pressures, the systems are infinitely stable. Generally, the systems are stable over a wide range of conditions including temperatures below 0° C. In practice, it may be useful to stir or mix the system slightly in order to speed the formation, however, if given enough time, the fluid systems of the present invention would form spontaneously. There is no need for work to be input into the system as is the case for a macroemulsion. Thus, even with slight mixing, the present invention requires significantly less mixing and power than required to form a macroemulsion, thereby saving time and money. While it is possible to "break" or separate the fluid systems by lowering the temperature, the fluid systems form spontaneously agin upon rewarming above the separttion temperature.

The fluid systems of the present invention are defined by the components of the system and also by the size of the droplets contained in the system. The fluid systems comprise water, oil and amphiphiles—a surfactant and usually a cosurfactant. The general formula for the inventive fluid systems may be given in weight percent as follows: water 1–70%, oil 5–85%, surfactant 5–20%, and cosurfactant 0–35%. It is recognized that some of the fluid systems included in the invention may not include any cosurfactant as it is possible to have a stable system with only a surfactant or mixtures of surfactants. Most preferably, the composition of the fluid systems is 25–50% water, 5–20% surfactant, 10–35% cosurfactant and 10–40% diesel fuel oil. The system may also contain other components such as additive fuels, e.g., methanol. The order of mixing of the components is unimportant as again, the microemulsion will form spontaneously with the necessary ingredients present. From a practical standpoint, however, any solid components should first be dissolved in either the water or the oil phase. In contrast, macroemulsions require energy input into the system usually in the form of vigorous mixing to form the emulsion. Also, the macroemulsions having oxidizer salts dissolved in the aqueous phase generally require heating to dissolve the oxidizer.

As known in the emulsion art, macroemulsions have a discontinuous or dispereed phase in the form of droplets held within the continuous phase. The droplets typically range in size from about 1 micron to over 100 microns. In U.S. Pat. No. 4,357,184, Binet discloses an emulsion with droplet sizes within the range of 1–15 microns. Cescon in U.S. Pat. No. 4,555,278 discloses an emulsion/nitrate particle blend in which the emulsion has droplets in the dispersed phase that range in size from 1 to 4 microns. Cescon also teaches against the cell size of the present invention in order to achieve stability.

The fluid systems of the present invention, however, have droplet diameters equal to or less than about 0.1 microns as measured by light scattering analysis. As known in the emulsion art, the dispersed droplets in a microemulsion typically range in size from 20–100 nanometers or 0.02–0.1 microns. Micellar systems have a cell size typically ranging from 5–20 nanometers, and for purposes of this invention, are included within the definition of a microemulsion. Cosolubilized systems may not have any aggregate of material that normally can be considered a droplet as individual molecules are dispersed in the solution, but as defined in the art, cosolubilized systems have an aggregate of material with a diameter of from 0 to 5 nanometers. These systems are all included in the present invention.

As used herein, a droplet refers to any aggregate of material that has an inner core of one material and an interfacial region that separates the inner core from the second material. The definition of a droplet as used herein includes layers of material as might be found in a bi-continuous system as well as the more typical droplet formation found in an emulsion. The definition of a diameter as used herein includes the thickness of layers as might be found in a bi-continuous system. Thus, the description that any droplet formation within the system has a diameter of less than or equal to about 0.1 microns refers not only to the droplets in a microemulsion but also to the thickness of layers of material in bi-continuous and other fluid systems.

The fluid systems of the peesent invention are usually transparent with a color tint such as is found in diesel fuel oil. Some of the inventive systems may also be considered translucent. By comparison, macroemulsion are never transparent and are usually murky and somewhat opaque. A large percentage of microemulsions are also optically isotropic meaning that a beam of polarized light will be refracted in the same way regardless of the angle of the beam. Some of the fluid systems included in the present invention are anisotropic.

Also by comparison, the fluid systems of the present invention exhibit ultralow interfacial tension on the order of 0.01 dyne/cm or lower. Interfacial tension can be a measure of the resistance of one liquid toward mixing with a second liquid. By contrast, saturated aqueous ammonium nitrate and oil containing 25% by weight of a surfactant forms a relatively stable macroemulsion with an interfacial tension of about 2 dyne/cm. Interfacial tensoon can be measured by a spinning interfacial tensiometer, and it provides a clear distinction between macro and micro emulsions. The relatively low interfacial tension in a microemulsion allows the emulsion to be almost infinitely stable while the relatively high interfacial tension in a macroemulsion will cause eventual separation of the phase in the macroemulsion. The fluid systems of the present invention also have relatively low viscosity when compared to macroemulsions.

Generally, microemulsions require relatively large amounts of surfactants and cosurfactants such as on the order of 5–55% by weight of the total solution. Typically, macroemulsions may be formed with lower levels of surfactants. The surfactants that are useful in the present invention may be anionic, cationic, or nonionic materials that are partially soluble in both the water and oil phases. Ionized surfactants include those commonly known to those skilled in the art of emulsion technology. Examples include sodium and potassium soaps such as, for example, sodium stearate, sodium oleate, sodium lauryl sulfates, dialkylsulfosuccinic, benzene sulfonates, and quaternary ammonium halides. Examples of the most commonly used nonionic emulsifiers useful as surfactants in the present invention are the polyoxyethylene$_{[n]}$ alkyl ethers and polyoxy-ethylene$_{[n]}$ phenyl ethers where $2 \leqq n \leqq 12$ and [n] denotes the number of ethylene oxide units (—$CH_2$—$CH_2$—O—) present in the hydrophilic portion of the molecule. Other possible nonionic surfactants include phosphate esters, amides, amines, polyols or biological surfactants. Other useful anionic, cationic, or nonionic surfactants are listed in the well known publication "McCutcheon's Detergents & Emulsifiers." In a preferred embodiment of the invention, a potassium soap is used as the surfactant which is formed in-situ by dissolving a fatty acid into the oil phase and potassium hydroxide into the water phase prior to mixing.

While cosurfactants are not required in all the fluid systems defined by the present invention, it is preferred to have a cosurfactant in the system in the amount of 0–35% by weight of the system. The cosurfactants generally employed in the formation of microemulsions and fluid systems of the present invention are low-molecular weight, polar species such as, but not limited to, lower alcohols, ketones, amides, and lower amines. Other possible cosurfactants include dimethyl-sulfoxide (DMSO) and other sulfones. The length of the hydrocarbon portion of the cosurfactant molecule is generally in the range $C_1$ to $C_{10}$ with $C_4$ to $C_7$ being preferred. The preferred cosurfactants may also be considered a fuel such as hexanol and pentanol.

The selection of the cosurfactant exhibits another difference between the fluid systems included in the present invention and macroemulsions. In macroemulsions, it is common practice to use a mixture of two or more surfactants each of which can be considered a "cosurfactant" of the other(s). In practice, this is done to "adjust" the HLB value of the mixture so that the final emulsion formed from the mixture of surfactants is more stable than an emulsion formed from one or the other surfactants alone. In the case of a microemulsion, however, the term cosurfactant means something different than simply a mixture of surfactants. In a microemulsion, the cosurfactant "prepares" the oil/water interface so that the surfactant may spread more easily over it. For this reason, most microemulsions require the presence of a cosurfactant in order to form spontaneously and to ensure a stable microemulsion.

Various types of organic oils may be used in the present invention including a wide range of petroleum distillates, vegetable oils or mineral oils. It is preferred to use diesel fuel oil as it is inexpensive and readily available, but other types of organic oils may be substituted for diesel fuel oil. An advantage of the present invention is that the fluid systems may be prepared to handle much the same as diesel fuel oil in the preparation of ANFO. It would be desirable, therefore, that any other oil have a viscosity or is modified to have a viscosity similar to diesel fuel oil. Similarly, the resulting fluid system should have a viscosity in the range of diesel fuel oil.

Additionally, other components may be included in the fluid systems of the present invention such as water-miscible or oil-miscible fuels that may be added to the water or oil phases prior to formation of the systems. Examples of such additional components include inorganic nitrates, acetates, methanol, and ethylene glycol. The chemical nature and amount of such added material is limited only by the ability of the surfactant/cosurfactant system to solubilize the water and oil phases. Additives may also be included to improve the low temperature stability of the fluid system. Other additives may be included to equalize the oxygen balance (relative to $CO_2$) of the fluid system when added to AN prills.

The present invention also provides an explosive composition comprising the mixture of a fluid system as described above with a solid oxidizer. The oxidizer is mixed with the fluid system so as to adequately coat the oxidizer with the fluid. This may be accomplished using the same equipment now used to mix ANFO. The preferred oxidizer is a nitrate selected from ammonium nitrate, sodium nitrate, potassium nitrate, calcium nitrate or mixtures thereof. Typically, ammonium nitrate is used by itself or in combination with the other nitrates. The solid oxidizer may be in virtually any form such as flakes, grinds, particles, blocks, balls, but the preferred form is prills. The most preferred solid oxidizer is ammonium nitrate prills. This also includes ANFO formulations. The solid oxidizer may comprise a mixture of two or more known oxidizers. A fluid system as described above may be added to a solid oxidizer in the amount of 2–20% by weight of the total composition with the remaining 80–98% comprising the solid oxidizer. Above about 15% fluid in the composition, the use of the explosive may be limited to larger boreholes. In addition to a solid oxidizer, the explosive compositions of the present invention may include a solid fuel mixed in with the oxidizer. Examples include coal, ferrophosphorous, aluminum, urea, sawdust, gilsonite and sugar.

The fluid systems of the present invention may be prepared such that they have a similar viscosity to diesel fuel oil. This enables the mixing of the fluid systems with AN prills to be performed using the same equipment available to the users of ANFO. Thus, the explosive compositions of the present invention may be made and handled without the need for additional equipment. Again, the handling of the explosive compositions is an important advantage of the present invention over the prior art. Also, the fluid systems do not require constant heating as required by emulsions in the prior art. The fluid systems can be stored and allowed to freeze and heated only prior to use. Upon heating, the fluid systems automatically return to their stable formulation. In contrast, a macroemulsion would tend to break upon freezing and it would require more work and agitation to reform the macroemulsion. Typically, field operators do not have the equipment or the expertise to reemulsify a macroemulsion once it has broken. Thus, the fluid systems of the present invention are advantageous in that they can be handled in a like manner to diesel fuel oil using the same equipment and not being subject to degradation by low temperatures or temperature cycling.

When the fluid systems of the present invention are mixed with solid oxidizers, the fluid system acts upon the solids to increase the overall density of the explosive composition. The density of the composition increases as the water in the fluid system is absorbed by the solids and the oxidizer partially dissolves in the water. Thus, the present invention also provides a method for increasing the density of explosive compositions containing solid oxidizers such as ANFO by mixing the composition with a fluid system as described herein.

The available energy from the explosive composition depends significantly on the oxygen balance. Generally, the closer it is to zero, the higher the available energy. The oxygen balance of an explosive system is a measure of the potential efficiency of the system.

It is preferred that the oxygen balance of the explosive composition fall within the range −20 to 20, and most preferably within the range −2 to 2. The various components of the system may be adjusted to fall within this range. For example, sodium and potassium nitrates are more oxygen positive than ammonium nitrate and therefore would require more fuel in the explosive composition to get an acceptable oxygen balance. If ANFO is used as the solid oxidizer, less fuel may be used in the fluid system. If a low percentage of fluid is used in the explosive composition (2–5%) then more fuel is required to provide an oxygen balance. Again, the fuel may be a liquid or solid dissolved in either the water or oil phases of the fluid system, or the fuel may be mixed with the solid oxidizer.

Other considerations that enter into the selection of the percentage of components in the system include its intended use, porosity of the solid oxidizer, cost and the limits of the surfactant/cosurfactant to solubilize the water and oil. If the fluid system is intended for use in a cold climate, then it may be desirable to adjsst the components to lower the separation temperature. The porosity of the solid oxidizer also influences the makeup of the fluid system. The more porous the solid the more liquid it will absorb and the more liquid is needed in the composition to fill the interstitial voids between the prills as well as the pores within the prills. Cost is another factor that influences the makeup of the system. Diesel fuel oil is less expensive than most other oils. Low alcohols are also less expensive than other types of cosurfactant. Finally, the fluid systems are limited to some extent by the ability of the surfactant/cosurfactant to solubilize the system.

The following Examples describe the present invention and its associated advantages in more detail. The results are shown in Tables 1, 2 and 3.

EXAMPLES 1–3

A microemulsion was formed using 30% by weight of water, 43.8% diesel fuel oil, 12.1% oleic acid, 11.6% n-hexanol, and 2.5% potassium hydroxide. The n-hexanol served as the cosurfactant for the emulsion, and the surfactant was potassium oleate which was formed insitu as the neutralization salt of the potassium hydroxide and the oleic acid. The potassium hydroxide was initially dissolved in the water and the oleic acid was dissolved in the oil prior to the combination of the water and the oil. The system was stirred slightly to speed the spontaneous formation of the microemulsion.

The microemulsion was then combined with ammonium nitrate (AN) prills in varying ratios using equipment commonly used for mixing ANFO. The AN prills were industrial grade prills. In Example 1, the microemulsion comprised 6% by weight and the AN 94% by weight of the resulting explosive composition. For Example 2, the ratio of microemulsion to AN prills was 9:91, and for Example 3, the ratio was 12:88. This variance in ratios of microemulsion to AN demonstrates the effect that the increased amount of emulsion and thus water has upon the density of the explosive composition. Cup densities for the various compositions were measured in the laboratory after one hour and are shown in Table 1. It was observed that the density of the composition reaches nearly its maxiuum value immediately upon mixing although some settling and packing of the product was observed to occur over time. This process was observed to be essentially complete after about one hour. The densities showed an increase of 5–13% When compared to the density of ANFO prepared from 6% diesel fuel oil and 94% AN industrial grade prills, the density of ANFO being typically about 0.82 g/cc.

EXAMPLES 4–6

Similar to the procedures of Examples 1–3, a microemulsion was formed using 34.1% by weight of water, 1.6% sodium hydroxide which was dissolved in the water prior to mixing, 11.1% hexanol, 11.5% oleic acid, and 41.7% diesel fuel oil with the oleic acid being dissolved in the oil prior to mixing. Again, the resulting microemulsion was mixed with AN prills in varying ratios. The density of the composition was recorded at one hour and the results are shown in Table 1.

EXAMPLES 7–9

In these Examples, a different surfactant and cosurfactant were used and a water-miscible fuel was added. The surfactant used was sodium dodecyl sulfate which comprised 10.3% by weight of the microemulsion. The cosurfactant was pentanol and it comprised 22.1% of the microemulsion. Methanol was added as the fuel in the amount of 6.5% by weight of the emulsion. The water and diesel fuel oil were 24.8% and 36.4% by weight respectively. When mixed with the AN prills, the densities were as shown in Table 1.

EXAMPLES 10–12

In addition to fuels such as methanol, water soluble salts such as sodium acetate also may be added to the microemulsion. These Examples included 0.5% by weight of sodium acetate and 7.3% of methanol. The other components were as listed in Table 1.

EXAMPLES 13–16

These Examples show the use of microemulsions as described by the present invention incorporated into explosive compositions that are nearly oxygen balanced. The components of the microemulsions were as shown in Table 2. All of the microemulsions contained methanol as an additive fuel. The microemulsions were mixed with two different types of AN prills in the ratio of 10% microemulsion and 90% AN prills by weight in the product. Examples 13 and 14 used agricultural grade prills while Examples 15 and 16 used an intermdiate type of prill. The explosive compositions were loaded in a borehole of diameter 6.75 inches using conventional equipment known in the industry for use with ANFO. The length of the column varied as indicated in Table 2. The density was measured and the oxygen balance relative to $CO_2$ was determined. The explosive composition was detonated and the velocity of detonation (VOD) in feet per second was measured. These values are recorded in Table 2.

EXAMPLES 17–21

In the above Examples, a difference was noted in the density of explosive compositions containing different grades of AN prills. Examples 17–21 compare industrial grade prills with agricultural grade prills. A microemulsion consisting of 33.5% water, 11.2% methanol, 2% potassium hydroxide, 18.% hexanol, 10.6% oleic acid and 24.6% diesel fuel oil was used in Examples 18, 19 and 21. Examples 17 and 20 acted as controls and used diesel fuel oil in place of the microemulsion. The ratios of the components and the resulting densities are shown in Table 3. These Examples show how a difference in the physical features of the solid oxidizer affect the densifying effect shown in the present invention.

The Examples shown in Table 1 illustrate various microemulsions described by the present invention. In particular, the Examples 1–12 illustrate various combinations of surfactants and cosurfactants and illustrate that additional fuels and oxygen-supplying salts may be added to the fluid system. Within each series of three examples, the ratio of microemulsion to AN prill is varied to illustrate the overall density increase that occurs when a greater amount of microemulsion is added to the explosive composition Table 2 shows actual microemulsions used together with AN prllls to formulate an explosive. The results of Examples 13–16 show the level of densities that are achievable in the field through use of the present invention. Also shown is the VOD provided by the detonation of these explosive ccmpositions. Table 3 shows the difference in densities obtainable with agricultural grade and industrial grade prills.

The fluid systems of the present invention have the advantage of being stable against separation which allows for an indefinite shelf life. The preferred microemulsion also forms spontaneously over a certain range of temperatures and pressures. Thus, the microemulsion is ideal for applications in which the fluid system may undergo temperature transitions during storage or transport. If the temperature of the microemulsion drops below its separation temperature, the emulsion may break, but the microemulsion forms spontaneously again when it is heated above the critical temperature. It does not break or separate or require additional mixing as a macroemulsion might under similar conditions.

Another important advantage of the present invention is the density increasing action that is demonstrated when fluid systems of the present invention are combined with solid oxidizers such as ammonium nitrate prills. The increase in density leads to increased energy available from the detonation of the explosive. The explosive compositions of the present invention demonstrate densities greater than that obtained with ANFO. Indeed, densities of 1.2 and greater are achievable bytthe present invention.

Having described but a few embodiments and advantages of the presnnt invention, it will be apparent to those skilled in the art that modifications and adaptations may be made without departing from the scope of the inventoon.

TABLE 1

| | Example | | | | | | | | | | | |
|---|---|---|---|---|---|---|---|---|---|---|---|---|
| Components | 1 | 2 | 3 | 4 | 5 | 6 | 7 | 8 | 9 | 10 | 11 | 12 |
| Water (wt. %) | 30 | 30 | 30 | 34.1 | 34.1 | 34.1 | 24.8 | 24.8 | 24.8 | 28.2 | 28.2 | 28.2 |
| Diesel fuel oil (wt. %) | 43.8 | 43.8 | 43.8 | 41.7 | 41.7 | 41.7 | 36.4 | 36.4 | 36.4 | 41.3 | 41.3 | 41.3 |
| Surfactant | | | | | | | | | | | | |
| wt % | 14.6 | 14.6 | 14.6 | 13.1 | 13.1 | 13.1 | 10.3 | 10.3 | 10.3 | 13.6 | 13.6 | 13.6 |
| form | 2.5% potassium hydroxide with 12.1% of oleic acid | | | 1.6% sodium hydroxide with 11.5% oleic acid | | | sodium dodecyl sulfate | | | 2.2% potassium hydroxide with 11.4% oleic acid | | |
| cosurfactant (wt % and form) | 11.6% hexanol | | | 11.1% hexanol | | | 27.1% pentanol | | | 9.1% pentanol | | |
| Additives | — | | | — | | | 6.5% methanol | | | 7.3% methanol 0.5% sodium acetate | | |
| % microemulsion in expolosive | 6 | 9 | 12 | 6 | 9 | 12 | 6 | 9 | 12 | 6 | 9 | 12 |
| % AN prills | 94 | 91 | 88 | 94 | 91 | 88 | 94 | 91 | 88 | 94 | 91 | 88 |
| Density at 1 hour (g/cc) | 0.86 | 0.87 | 0.93 | 0.88 | 0.89 | 0.93 | 0.88 | 0.89 | 0.93 | 0.88 | 0.89 | 0.93 |

TABLE 2

| Microemulsion | 13 | 14 | 15 | 16 |
|---|---|---|---|---|
| Water | 33.7 | 33.5 | 33.5 | 33.5 |
| Methanol | 8.7 | 11.2 | 11.2 | 11.2 |
| Potassium Hydroxide | — | 2.0 | 2.0 | 2.0 |
| Pentanol | 29.6 | — | — | — |
| Hexanol | — | 18.1 | 18.1 | 18.1 |
| Oleic Acid | — | 10.6 | 10.6 | 10.6 |
| Sodium Dodecyl Sulfate | 13.8 | — | — | — |
| Diesel Fuel Oil | 14.6 | 24.6 | 24.6 | 24.6 |
| % of Microemulsion | 10 | 10 | 10 | 10 |
| % AN prill | 90 | 90 | 90 | 90 |
| Oxygen Balance | 0.843 | −0.145 | −0.145 | −0.145 |
| Borehole Diameter (in.) | 6.75 | 6.75 | 6.75 | 6.75 |
| Column Length (ft.) | 15 | 15 | 7 | 67 |
| Density g/cc | 1.19 | 1.1–1.3 | 1.07 | 1.07 |
| VOD (fps) | 12,200 | 12,800 | — | 14,200 |

TABLE 3

| Example | 17 | 18 | 19 | 20 | 21 |
|---|---|---|---|---|---|
| AN Industrial | 94 | 94 | 90 | — | — |

TABLE 3-continued

| Example | 17 | 18 | 19 | 20 | 21 |
|---|---|---|---|---|---|
| AN Agricultural Prill | — | — | — | 94 | 90 |
| Diesel Fuel Oil | 6 | — | — | 6 | — |
| Microemulsion | — | 6 | 10 | — | 10 |
| Density (g/cc) | .82 | .85 | .90 | 1.0 | 1.22 |

We claim:

1. A thermodynamically stable fluid system that forms an explosive composition when combined with a solid oxidizer, the fluid system comprising the combination of water in the amount of 1–70% by weight of the system, a surfactant in the amount of 5–20% by weight, a cosurfactant in the amount of 0–35% by weight, and an organic oil in the amount of 5–85% by weight, and any droplet formation within the system has a diameter of less than or equal to about 0.1 microns.

2. The fluid system of claim 1 wherein the system forms a microemulsion.

3. The fluid system of claim 1 wherein the system is a cosolubilized solution.

4. The fluid system of claim 1 wherein the system is optically isotropic.

5. The fluid system of claim 1 further comprising a water-soluble fuel.

6. The fluid system of claim 1 further comprising a fuel soluble in the oil component.

7. The fluid system of claim 1 wherein the surfactant is selected from the group consisting of sodium or potassium neutralization salts of stearic, oleic, lauryl sulfonic, dialkylsulfosuccinic or benzene sulfonic acids, quaternary alkyl ammonium salts, polyoxyethylene alkyl and phenyl ethers, phosphate esters, amides, polyols and combinations thereof.

8. The fluid system of claim 1 wherein the cosurfactant is selected from the group consisting of those alcohols, ketones, amides, and amines having 1–10 carbon atoms, and mixtures thereof.

9. The fluid system of claim 1 wherein the system exhibits an interfacial tension less than or equal to about 0.01 dynes/cm.

10. An explosive composition comprising the mixture of a sllid oxidizer with a thermodynamically stable fluid microemulsion system comprising the combination of water in the amount of 1–70% by weight of the fluid system, surfactant in the amount of 5–20% by weight of the fluid system, a cosurfactant in the amount of 0–35% by weight of the system, and an organic oil in the amount of 5–85% by weight of the fluid system, and any droplet formed within the fluid system have a diameter of less than or equal to about 0.1 microns.

11. The explosive composition of claim 10 wherein the surfactant is selected from the group consisting of sodium or potassium neutralization salts of stearic, oleic, lauryl sulfonic, dialkylsulfosuccinic or benzene sulfonic acids, quaternary alkyl ammonium salts, polyoxyethylene alkyl and phenyl ethers, phosphate esters, amides, polyols and combinations thereof.

12. The explosive composition of claim 10 wherein the cosurfactant is selected from the group consisting of those alcohols, ketones, amides, and amines having 1–10 carbon atoms, and mixtures thereof.

13. The explosive composi&ion of claim 10 further comprising a water-soluble fuel in an amount up to about 50% by weight of the fluid system.

14. The explosive composition of claim 10 further comprising a fuel soluble in the oil component in an amount up to about 50% by weight of the fluid system.

15. The explosive composition of claim 10 further comprising a solid fuel mixed with the solid oxidizer.

16. The explosive composition of claim 10 wherein the oxidizer is selected from the group consisting of: ammonium nitrate, sodium nitrate, potassium nitrate, calcium nitrate, and mixtures thereof.

17. The explosive composition of claim 16 wherein the oxidizer is in prill form.

18. The exposive composition of claim 10 wherein the oxidizer is a mixture of ammonium nitrate prills with fuel oil in a ratio of about 94:6.

19. The explosive composition of claim 10 wherein the explosive composition is oxygen balanced to within the range −20 to +20.

20. The explosive composition of claim 10 wherein the explosive composition is oxygen balanced to within the range −2 to +2.

21. The explosive composition of claim 10 wherein the solid oxidizer comprises 80–98% by weight of the explosive composition.

22. An explosive composition comprising the mixture of a solid oxidizer with a thermodynamically stable, optically isotropic microemulsion comprising water in the amount of 1–70% by weight of the emulsion, a surfactant in the amount of 5–20% by weight of the emulsion, a cosurfactant in the amount of 0–35% by weight of the emulsion, and an organic oil in the amount of 5–85% by weight of the emulsion, and the diameter of droplets within the microemulsion is less than or equal to about 0.1 microns.

23. The explosive composition of claim 22 wherein the solid oxidizer is selected from the qroup consisting of: ammonium nitrate, sodium nitrate, potassium nitrate, calcium nitrate a mixture of ammonium nitrate prills with fuel oil in a ratio of about 94:6, and combinations thereof.

24. The explosive composition of claim 22 wherein the solid oxidizer is in prill form.

25. The explosive composition of claim 22 wherein the surfactant is selected from the group consisting of sodium or potassium neutralization salts of stearic, oleic, lauryl sulfonic, dialkylsulfosuccinic or benzene sulfonic acids, quaternary alkyl ammonium salts, polyoxyethylene alkyl and phenyl ethers, phosphate esters, amides, polyols and combinations thereof.

26. The explosive composition of claim 22 wherein the cosurfactant is selected from the group consisting of those alcohols, ketones, amides and amines having 1–10 carbon atoms, and mixtures thereof.

27. The explosive composition of claim 22 wherein the microemulsion is comprised of 25–50% by weight of water, 1–40% by weight of oil, 5–20% by weight of surfactant and 1–35% by weight of cosurfactant.

28. The explosive composition of claim 22 wherein the organic oil is diesel fuel oil.

29. The explosive composition of claim 22 further comprising an additive fuel added to the microemulsion in an amount up to 50% by weight of the microemulsion.

30. The explosive composition of claim 29 wherein the fuel is methanol.

31. The explosive composition of claim 22 further comprising a solid fuel mixed with the oxidizer.

32. The explosive composition of claim 22 wherein it is oxygen balanced to within the range −2 to 2.

33. The explosive composition of claim 26 wherein the solid oxidizer comprises 80–98% by weight of the composition.

34. A method for providing an explosive composition containing a solid oxidizer and having a higher density than ANFO under similar conditions, the method comprising: (a) forming a thermodynamically stable fluid microemulsion system comprising 1–70% by weight of water, 5–20% by weight of a surfactant, 0–35% by weight of a cosurfactant, and 5–85% by weight of an organic oil, and droplets formed within the fluid system have a diameter less than or equal to about 0.1 microns, and (b) mixing the fluid system with the solid oxidizer to adequately coat the oxidizer and allow water contained within the fluid system to contact the oxidizer.

35. The method of claim 34 wherein the solid oxidizer is selected from the group consisting of ammonium nitrate, sodium nitrate, potassium nitrate, calcium nitrate, a mixture of ammonium nitrate prills with a fuel oil and a ratio of about 94:6, and mixtures thereof.

36. The method of claim 34 wherein the solid oxidizer is in prill form.

37. The method of claim 34 wherein the surfactant is selected from the group consisting of: sodium or potassium neutralization salts of stearic, oleic, lauryl sulfonic, dialkylsulfosuccinic or benzene sulfonic acids, quaternary alkyl ammonium salts, polyoxyethylene alkyl and phenyl ethers, phosphate esters, amides, polyols and combinations thereof.

38. The method of claim 34 wherein the cosurfactant is selected from the group consisting of those alcohols, ketones, amides, and amines having 1–10 carbon atoms, and mixtures thereof.

39. The method of claim 34 wherein the fluid system further comprises a fuel in the amount of up to 50% of the fluid system.

40. The method of claim 34 further comprising mixing a solid fuel with the solid oxidizer prior to, during or after step (b).

41. The method of claim 34 wherein the solid oxidizer comprises 80–98% by weight of the explosive composition.

42. An explosive composition comprising the mixture of a solid oxidizer with a thermodynamically stable fluid system comprising the combination of water in the amount of 1–70% by weight of the fluid system, surfactant in the amount of 5–20% by weight of the fluid system, a cosurfactant in the amount of 0–35% by weight of the fluid system, and an organic oil in the amount of 5–85% by weight of the fluid system, which forms a cosulubilized fluid system.

43. The explosive composition of claim 42 wherein the fluid system is optically isotropic.

44. The explssive composition of claim 42 wherein the surfactant is selected from the group consisting of sodium or potassium neutralization salts of stearic, oleic, lauryl sulfonic, dialkylsulfosuccinic or benzene sulfonic acids, quaternary alkyl ammonium salts, polyoxyethylene alkyl and phenyl ethers, phosphate esters, amides, polyols and combinations thereof.

45. The explosive composition of claim 42 wherein the cosurfactant is selected from the group consisting of those alcohols, ketones, amides, and amines having 1–10 carbon atoms, and mixtures thereof.

46. Explosive composition of claim 42 further comprising a water-soluble fuel in an amount up to about 50% by weight of the fluid system.

47. The explosive composition of claim 42 further comprising a fuel soluble in the oil component in an amount up to about 50% by weight of the fluid system.

48. The explosive composition of claim 42 further comprising a solid fuel mixed with the solid oxidizer.

49. The explosive composition of claim 42 wherein the oxidizer is selected from the group consisting of: ammonium nitrate, sodium nitrate, potassium nitrate, calcium nitrate, and mixtures thereof.

50. The explosive composition of claim 49 wherein the oxidizer is in prill form.

51. The explosive composition of claim 42 wherein the oxidizer is a mixture of ammonium nitrate prill and fuel in the ratio of about 94:6.

52. The explosive composition of claim 42 wherein the explosive composition is oxygen balanced to within the range −20 to +20.

53. The explosive composition of claim 42 wherein the explosive composition is oxygen balanced to within the the range −2 to +2.

54. The explosive composition of claim 42 wherein the solid oxidizer comprises 80–90% by weight of the explosive composition.

55. A method for providing an explosive composition containing a solid oxidizer and having a higher density than ANFO under similar conditions, the method comprising: (a) forming a thermodynamically stable fluid system comprising 1–70% by weight of water, 5–20% by weight of a surfactant, 0–35% by weight of a cosurfactant, and 5–85% by weight of an organic oil, to form a cosolubilized fluid system, and (b) mixing the fluid system with a solid oxidizer to adequately coat the oxidizer and allow water contained within the fluid system to contact the oxidizer.

56. The method of claim 55 wherein the solid oxidizer is selected from the group consisting of ammonium nitrate, sodium nitrate, potassium nitrate, calcium nitrate, a mixture of ammonium nitrate prills and fuel oil in a ratio of about 94:6, and combinations thereof.

57. The method of claim 55 wherein the solid oxidizer is in prill form.

58. The method of claim 55 wherein the surfactant is selected from the group consisting of: sodium or potassium neutralization salts of stearic, oleic, lauryl sulfonic, dialkylsulfosuccinic or benzene sulfonic acids, quaternary alkyl ammonium salts, polyoxyethylene, alkyl and phenyl ethers, phosphate esters, amides, polyols and combinations thereof.

59. The method of claim 55 wherein the cosurfactant is selected from the group consisting of those alcohols, ketones, amides, and amines having 1–10 carbon atoms and mixtures thereof.

60. The method of claim 55 wherein the fluid system further comprises a fuel in the amount of up to 50% of the fluid system.

61. The method of claim 55 further comprising mixing a solid fuel with the solid oxidizer prior to, during or after step (b).

62. The method of claim 55 wherein the solid oxider comprises 80–98% by weight of the explosive composition.

* * * * *

UNITED STATES PATENT AND TRADEMARK OFFICE

CERTIFICATE OF CORRECTION

PATENT NO. : 4,830,687

DATED : May 16, 1989

INVENTOR(S) : Mullay et al.

It is certified that error appears in the above-identified patent and that said Letters Patent is hereby corrected as shown below:

Column 1, line 31, "94to" should read --94 to--;
line 36, "sse" should read --use--;
Column 2, line 2, after "nitrate" insert --.--;
line 23, "strontimm" should read --strontium--;
line 63, "oxiiizer" should read --oxidizer--;
Column 4, line 49, after "component", insert --.--;
Column 5, line 35, "preeent" should read --present--;
line 55, "agin" should read --again-- and "separttion" should read --separation--;
Column 6, line 15, "dispereed" should read --dispersed;
Column 7, line 5, "tensoon" should read --tension--;
Column 9, line 49, "adjsst" should read --adjust--;
Column 10, line 28, "When" should read --when--;
Column 11, line 58, after "composition", insert --.--;
Column 12, line 20, "byt-" should read --by--;
line 23, "presnnt" should read --present--;
line 26, "inventoon" should read --invention--;
Column 12, the last line in Table 2, "12.200", "12.800" and "14.200" should read --12,200--, --12,800--, and --14,200--, respectively;
Column 13, line 46, "sllid" should read --solid--;
line 52, delete "any";
line 53, delete "droplet" and substitute therefor --droplets--;
line 66, "composi&ion" should read --composition--; and

UNITED STATES PATENT AND TRADEMARK OFFICE

CERTIFICATE OF CORRECTION

PATENT NO. : 4,830,687

DATED : May 16, 1989

INVENTOR(S) : Mullay et al.

It is certified that error appears in the above-identified patent and that said Letters Patent is hereby corrected as shown below:

Column 15, line 55, "explssive" should read --explosive--.

Signed and Sealed this

Thirtieth Day of January, 1990

*Attest:*

JEFFREY M. SAMUELS

*Attesting Officer*

*Acting Commissioner of Patents and Trademarks*